US005762569A

United States Patent [19]

Hale

[11] Patent Number: 5,762,569

[45] Date of Patent: Jun. 9, 1998

[54] DEVICE FOR CONVERTING A CONTAINER INTO A FIGURE TO SIMULATE AN INTERACTIVE GAME

[76] Inventor: Gary Allen Hale, 51 Brook St., East Hartford, Conn. 06108

[21] Appl. No.: 774,593

[22] Filed: Dec. 30, 1996

[51] Int. Cl.[6] ..... A63B 67/00

[52] U.S. Cl. ..... 473/480; 273/400; 473/481

[58] Field of Search ..... 473/481, 480, 473/479; 273/400, 398, 401, 402

[56] References Cited

U.S. PATENT DOCUMENTS

| | | | |
|---|---|---|---|
| D. 309,808 | 8/1990 | Phelps et al. . | |
| D. 334,958 | 4/1993 | Fischer . | |
| D. 339,890 | 9/1993 | Montgomery . | |
| D. 346,110 | 4/1994 | Hale . | |
| D. 346,111 | 4/1994 | Hale . | |
| 3,244,420 | 4/1966 | Poynter . | |
| 4,333,657 | 6/1982 | Jaworski et al. . | |
| 4,950,196 | 8/1990 | Fortune et al. . | |
| 5,064,195 | 11/1991 | McMahan et al. . | |
| 5,224,699 | 7/1993 | Zaruba . | |
| 5,238,243 | 8/1993 | Grispi | 273/400 X |
| 5,333,865 | 8/1994 | Holmes | 273/400 X |

*Primary Examiner*—William H. Grieb

*Attorney, Agent, or Firm*—St. Onge Steward Johnst & Reens LLC

[57] ABSTRACT

A device for converting a container into a figure to simulate an interactive game with a player, comprising a headboard in the shape of the head of the figure, a clip affixed to the headboard for attaching the headboard to the container, wherein a portion of the clip extends below the headboard where the clip connects to the container, a sensor mounted to the extending portion of the clip for generating an electrical signal in response to impact from an object projected by the game player, and feedback device responsive to the electrical signal generated by the sensor for providing feedback to the game player when an object has been properly received by the figure.

15 Claims, 5 Drawing Sheets

DEVICE FOR CONVERTING A CONTAINER INTO A FIGURE TO SIMULATE AN INTERACTIVE GAME

FIELD OF THE INVENTION

The invention relates to the field of amusements and games and more particularly to a device for converting a container into a figure to simulate an interactive game with a game player.

BACKGROUND OF THE INVENTION

Many different types of devices are known for converting containers into games. For example, miniature attachable basketball backboards for attaching to a waste basket are known in the art and include a variety of features for simulating the game of basketball.

U.S. Pat. No. 3,244,420 (Poynter) discloses a miniaturized basketball backboard for attaching to the rim of a waste basket. The backboard has a shape typical of all basketball backboards and has a rim and net for directing a thrown object into the waste basket and an upside down U-shaped clip for attaching the backboard onto the wastebasket.

U.S. Pat. No. 5,064,195 (McMahan et al.) discloses a novelty basketball goal for mounting onto a waste paper basket. The goal incorporates a hoop and a net with an electrical switch suspended in the net which generates a predetermined sound effect when an object comes in contact with the switch as it passes through the net. The hoop is affixed to a typical basketball backboard which can be removably clamped to a waste basket using a spring loaded clip.

The generic design of a basketball backboard limits the type of games which can be played to basketball and is not aesthetically pleasing. Also disadvantageously, the generic design of a basketball backboard does not simulate interaction with another player.

Also known are toys which are attached to baskets to provide a decorative present. U.S. Pat. No. 4,950,196 (Fortune et al.) discloses a stuffed animal for attaching to a basket to create a decorated gift basket. The stuffed animal is attached to the basket using VELCRO means affixed to both the stuffed animal and the basket. Feet can optionally be attached to the basket using a mounting bracket.

The stuffed animals are attached to the outside of the basket to allow more room inside the basket for other gifts, and are intended to be detached and used as clutch toys, puppets and/or slippers. The stuffed animals are not intended to include a game aspect, nor do they have a means to provide feedback to a game player.

I have previously obtained two U.S. Design Pat. Nos. 346,110 and 346,111 for container designs simulating sports figures. These devices, however, are a one piece pullover construction which make them suitable for only a limited size and shape of container. These designs also do not provide the interactive nature of an audible signal or other signals to embellish game playing by providing feedback to a game player What is desired, therefore, is a device which easily converts containers of various sizes and shapes into a figure for game playing and which provides feedback to a game player in terms of audible or other signals. The device would be both visually appealing and allow a player to participate in a game in the home, or to make clean up more pleasurable, by providing an interactive figure and feedback.

SUMMARY OF THE INVENTION

Accordingly, it is an object of the invention to provide a device for converting a container into a figure to simulate an interactive game with a player.

Another object of the invention is to provide a device for attachment to a container which provides feedback to a game player for a properly received attempt.

Still another object of the invention is to furnish the figure with interconnected appendages to further enhance the aesthetic enjoyment of the game and provide a means for increasing the level of challenge of the game.

Other objects of the invention will be obvious and may in part appear hereinafter.

These and other objects are achieved by provision of a device for converting a container into a figure to simulate an interactive game with a player, comprising a headboard in the shape of the head of the figure, a clip affixed to the headboard, wherein a portion of the clip extends below the headboard where the clip connects to the container, a sensor mounted to the extending portion of the clip for generating an electrical signal in response to impact from an object projected by the game player, and a feedback device responsive to the electrical signal generated by the sensor for providing feedback to the game player when an object has been properly received by the figure.

Preferably, the feedback device for providing feedback to the game player includes sound effects which can be altered with the optional addition of a recording means. It is also preferable that interconnected appendages are incorporated which add to the simulation of an interactive game and therefor the enjoyment of the game player.

The invention and its particular features and advantages will become more apparent from the following detailed description considered with reference to the accompanying drawings.

DETAILED DESCRIPTION OF THE INVENTION

Figure 1:
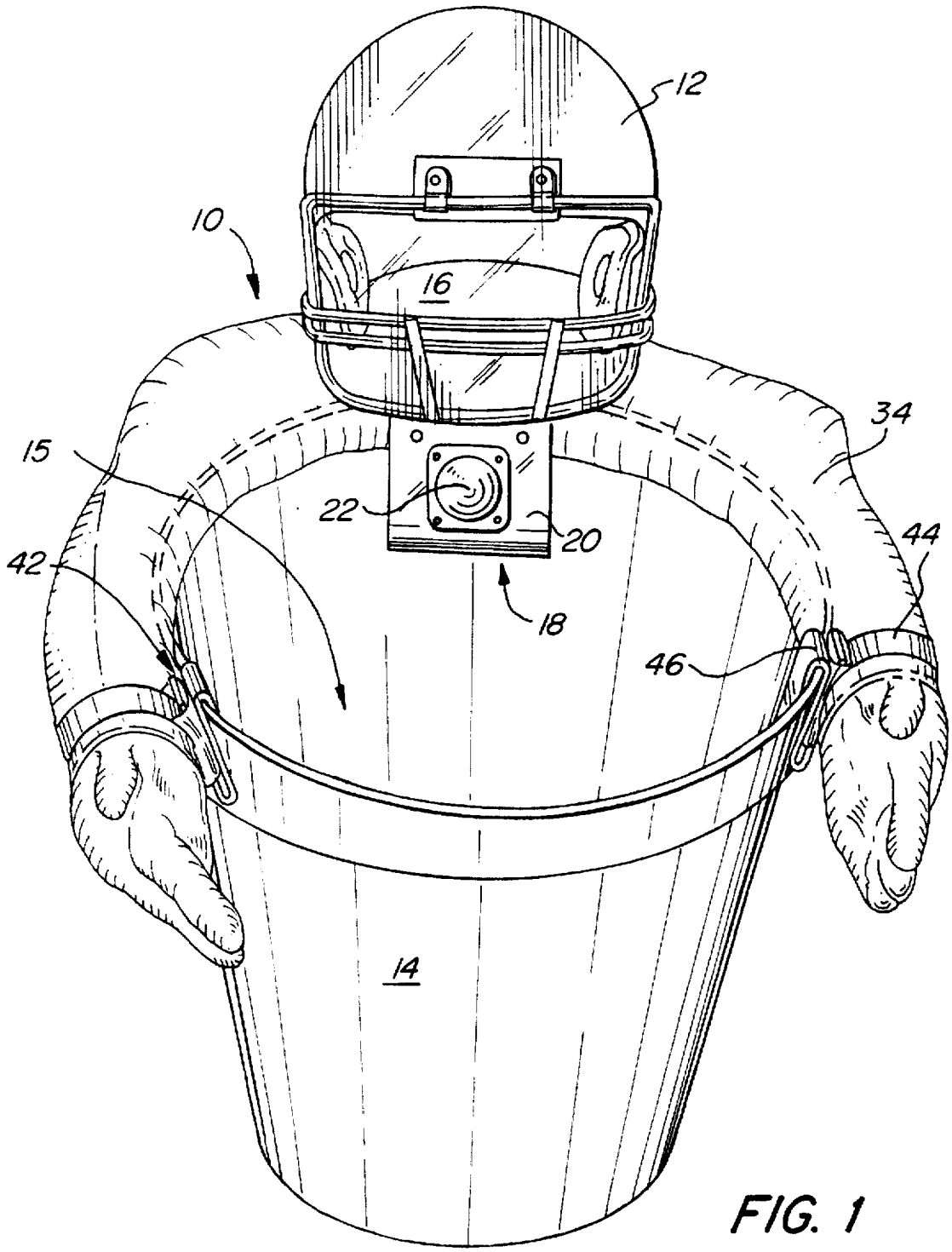
FIG. 1 is a front elevation view of an device for converting a container into a figure to simulate an interactive game with a player, in accordance with the invention, attached to a container.

FIG. 1 depicts a device 10 for converting a container 14 into a figure to simulate an interactive game with a player in accordance with the invention. In the use of device 10, container 14 can be any size, shape, or material, which has an internal cavity 15. Typically, container 14 would be a trash can, a laundry basket, or a cooler; it is understood, however, that other containers may also be used.

Headboard 12 is made in the shape of a figure such as a sports figure, an animal, either real or imaginary, or any combination thereof (one example would be a monster head in a football helmet with a favorite team logo). Headboard 12 can either be two or three dimensional. Further, headboard 12 may optionally have a location 16 for inserting a photo.

Figure 5:
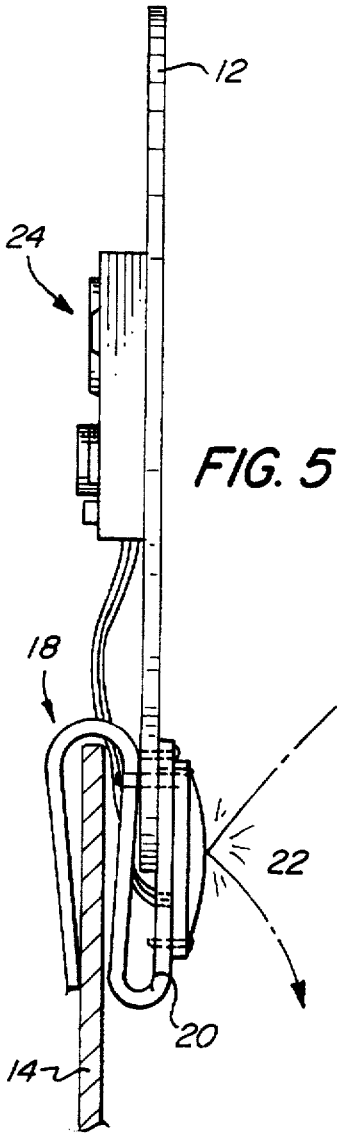
FIG. 5 is a side elevation view of the headboard in FIG. 4 to illustrate the extending portion of the clip and sensor in accordance with the invention.

A clip 18 is attached to headboard 12 such that a portion 20 extends below headboard 12. FIG. 5 illustrates the "N" shape of clip 18. Clip 18 can be made of any material which can withstand the forces with which it will be subjected to during use of device 10, yet flexible enough to easily allow its placement on and removal from container 14. Preferably clip 18 is made from a polycarbonite material having a high stress resistance such as GE Lexan™.

Figure 3:
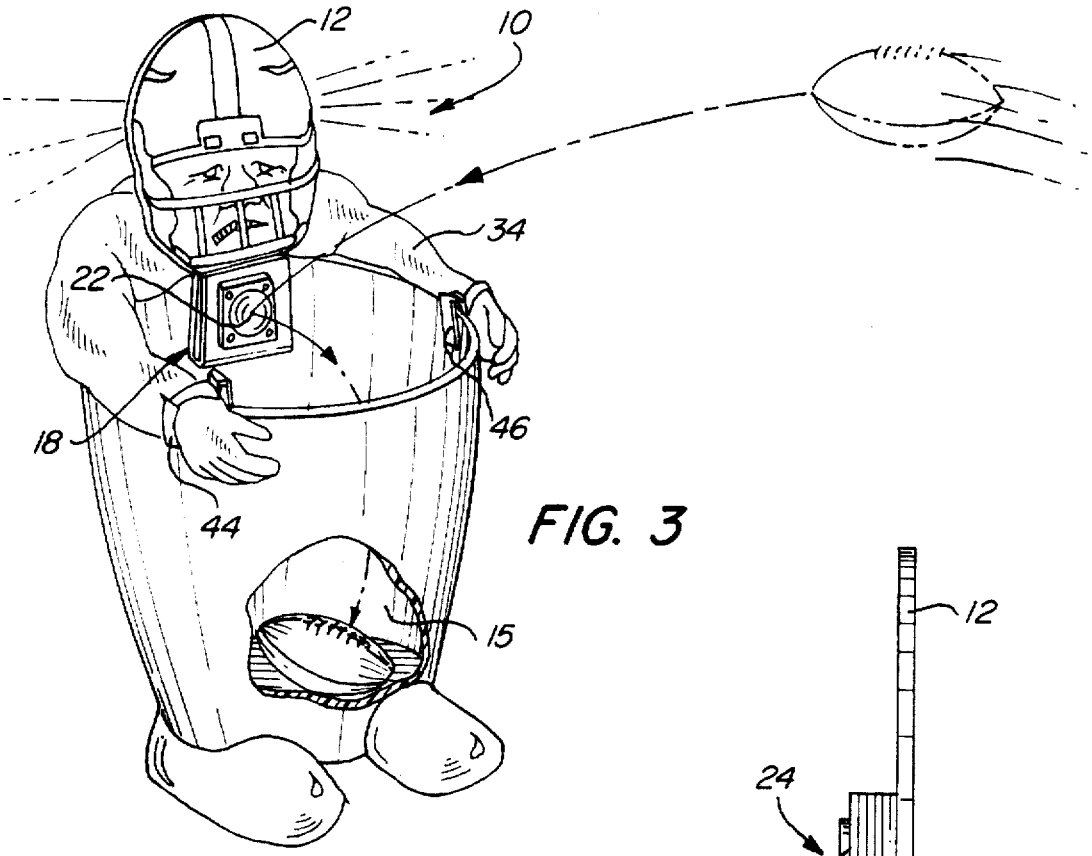
FIG. 3 is a front isometric view of the device for converting a container into a figure to simulate an interactive game with a player attached to a container in accordance with the invention to illustrate the illusion of an interactive game created when the device is used.

A sensor 22 is mounted onto extending portion 20 of clip 18, as illustrated in FIGS. 1, 3 and 5. Sensor 22 can be any type of sensor which generates an electrical signal in response to some sort of stimulus to sensor 22. Preferably, sensor 22 is either vibration, force, or motion activated.

Figure 6:
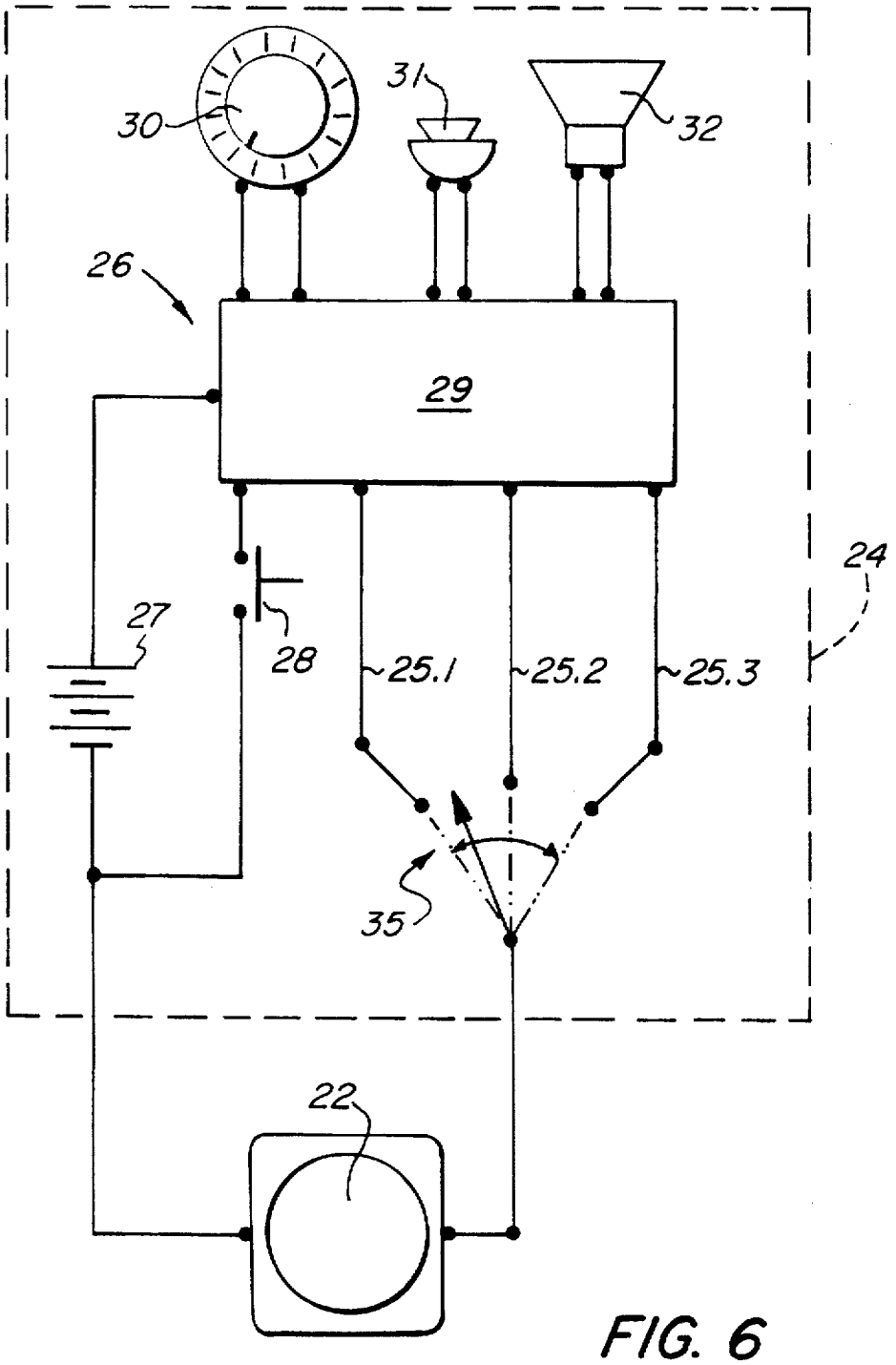
FIG. 6 is an electrical schematic of a feedback device for providing feedback in accordance with the invention.

Remotely located from sensor 22 is a feedback device 24 for providing feedback to the game player. FIG. 6 illustrates one possible configuration for feedback device 24 which incorporates three optional sound effects 25 and a recording device 26. A battery 27 is electrically connected to both a recording switch 28 and sensor 22. When recording switch 28 is closed, a digital sound recording chip 29 is activated to modify and save one of the optional sound effects 25.1, 25.2, and 25.3 selected using a switch 35. Volume control 30 and microphone 31 assist in the recording process. Optionally, optional sound effects 25.1 to 25.3 may be prerecorded with feedback appropriate to the figure (such as a cheering crowd or a siren). Using switch 35, the game player can select which of the optional sound effects 25.1 to 25.3 to alter with recording device 26 and which to use as pre-recorded. Use of recording device 26 would also allow a purchaser of device 10 to personalize a gift of device 10 to incorporate a message prior to delivery.

Figure 4:
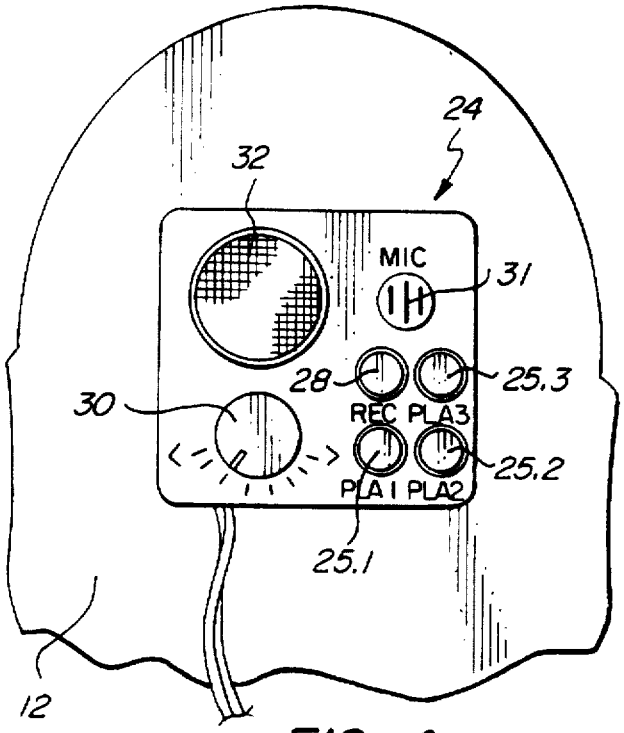
FIG. 4 is a rear elevation view of the headboard to illustrate a feedback device for providing feedback to the game player in accordance with the invention.

Because sensor 22 is located apart from feedback device 24, sensor 22 is electrically coupled to feedback device 24. When sensor 22 is activated, the loop is closed which activates one of optional sound effects 25.1, 25.2, or 25.3 which is delivered by speaker 32. The selection of which of optional sound effects 25.1, 25.2, or 25.3 is played can be accomplished in several ways. Either the game player can select which sound it would like to hear in response to a successful shot using a switch 35 for selecting an optional sound effect (as illustrated in FIGS. 4 and 6), sound effects 25 could be programmed to be played at random, or each optional sound effect 25.1, 25.2, and 25.3 could be connected to a separate sensor 22 to provide different feedback when each sensor 22 was activated.

Sensor 22 can be optionally located at other locations in device 10. It can be in the form of a pad or an extending wire and placed in internal cavity 15 of container 14. Use of different types sensors 22, or of combinations of types, provides different levels of difficulty for the game player's enhanced enjoyment of the simulated interactive game created by device 10. As pointed out above, each of these sensors 22 can be coupled with a different sound effect 25.1, 25.2, or 25.3 to provide different responses when objects are received by device 10 at different locations.

The electrical signal generated when sensor 22 is stimulated can also be used to trigger other effects which further enhance the enjoyment of device 10. Flashing lights, not shown, can be attached to headboard 12 which are triggered by the electrical signal. An electronic counter and corresponding display, also not shown, may also be employed to register the number of times sensor 22 was triggered.

Different types of sensors can also be combined which result in a different type of display and sound when each sensor is triggered. For example, headboard 12 could be equipped with a sensor 22 on extending portion 10 of clip 18 which creates a certain noise and/or flashing lights when struck. A pad type sensor 22 could also be placed at the bottom of internal cavity 15 of container 14 which triggers an electronic counter and corresponding display each time it is struck. Light sensitive switches could also be used to trigger the audible module when an object disrupts the light around the switch. These are examples of a number of combinations that could be employed.

Figure 2C:
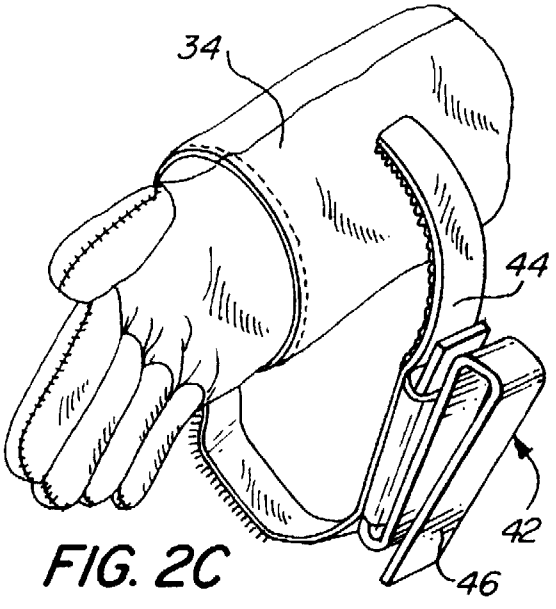
FIG. 2C is a front isometric view of one of the interconnected appendages in FIG. 2B to illustrate a means for attaching an interconnected appendage in accordance with the invention.
Figure 2A:
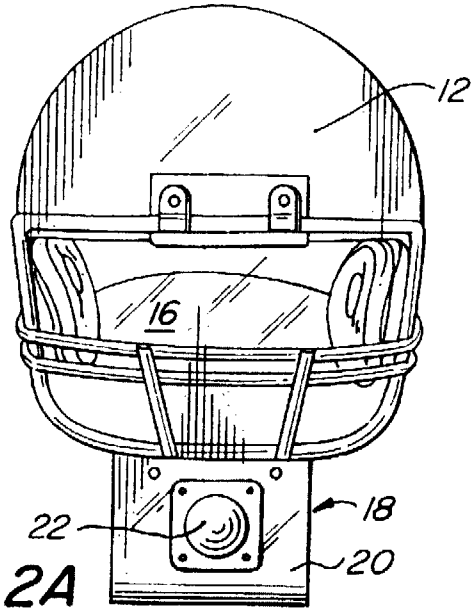
FIG. 2A is a front elevation view of a headboard in accordance with the invention.
Figure 2D:
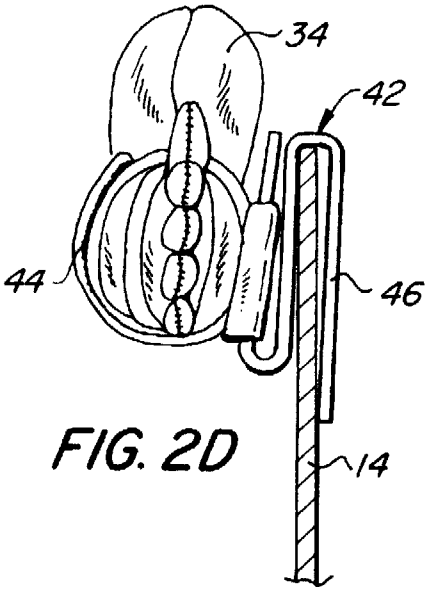
FIG. 2D is a side elevation view of one of the interconnected appendages in FIG. 2B to illustrate the attachment of an interconnected appendage to a container in accordance with the invention.

Interconnected appendages 34 may also be employed to further enhance the illusion of a head and body to simulate play with another. As illustrated in FIG. 2C, interconnected appendages 34 are equipped with means 42 for attaching interconnected appendages 34 to container 14. Means 42 for attaching interconnected appendages 34 to container 14 employed will typically depend on the surface characteristics of container 14. Preferably, a combination of VELCRO 44 and a clip 46 (similar to clip 18) are employed to secure interconnected appendages 34 to container 14, as illustrated in FIGS. 1, 2C and 2D.

Interconnected appendages 34 are made of any material which is flexible enough to adjust to any size and shape container 14, yet durable enough to withstand repeated use. Preferably, interconnected appendages 34 are made of an opaque, vinyl material which is cut and sewn in the desired shape and stuffed with a filler such as batting made from cotton, polyester, or a combination thereof. Interconnected appendages 34 could also be formed from a laminate which has an outer fuzzy material when the subject of headboard 12 is an animal type figure.

The configuration, color and material of interconnected appendages 34 will be determined by the subject chosen for headboard 12. For example, interconnected appendages 34 could be in the shape of hands in the case of a football player, lacrosse player, or basketball player (as illustrated in FIGS. 1–3). They could be in the shape of fins if the subject of headboard 12 is a fish, or paws for a bear.

Figure 7:
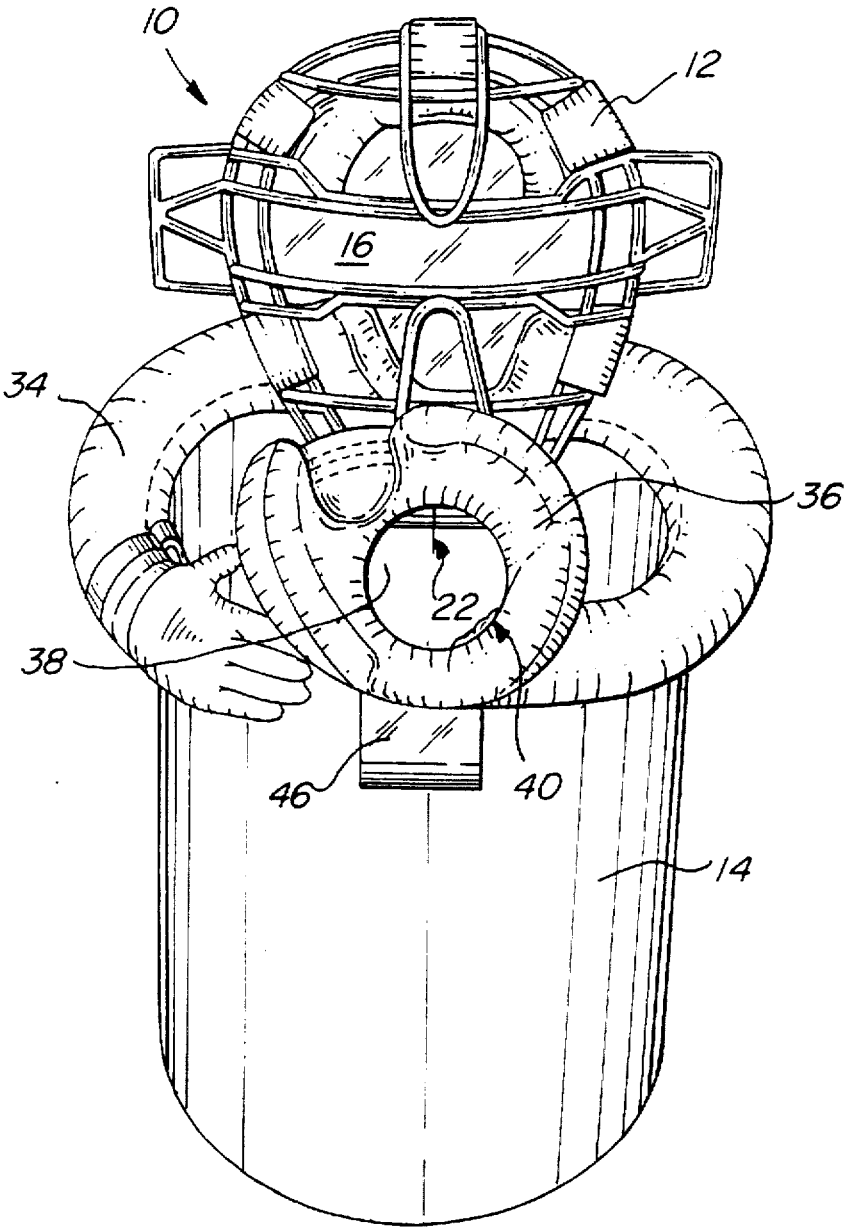
FIG. 7 is a front elevation view of the device in accordance with the invention to illustrate the optional use of a piece of equipment attached to interconnected appendages.

As illustrated in FIG. 7, when the subject of headboard 12 has arms which would typically hold a piece of equipment 36 (such as a glove for a boxer, baseball player, baseball catcher, or hockey goalie or a racquet for a tennis player) piece of equipment 36 can either be fabricated from the same material that interconnected appendages 34 are fashioned from, or from the same material which makes up headboard 12, depending on the desired appearance. Piece of equipment 36 can further include an aperture 38 in piece of equipment 36. Aperture 38 provides an additional level of skill in device 10.

Aperture 38 may also be equipped with a sensor 22 as illustrated in FIG. 7. Sensor 22 is attached to rim 40 of aperture 38 in piece of equipment 36 and extends radially inward from rim 40. When an object passes through aperture 38 and strikes sensor 22 an electrical signal is generated which can be coupled with feedback device 24 for providing feedback to the game player as discussed above.

Device 10 can be further enhanced by use of a wrapper 48 for container 14. Wrapper 48 has a design appropriate to the subject of headboard 12 on at least one side and a means for attaching it to container 14. Preferably, the design on wrapper 48 pictures the body features and clothing appropriate to the subject of headboard 12 or scenery typical of the environment of the subject of headboard 12. A different design could be located on each side of wrapper 48 in order to enable the game player to alter the setting of the game or to provide an alternative appearance to container 14 when headboard 12 and interconnected appendages 34 are not attached.

Figure 2B:
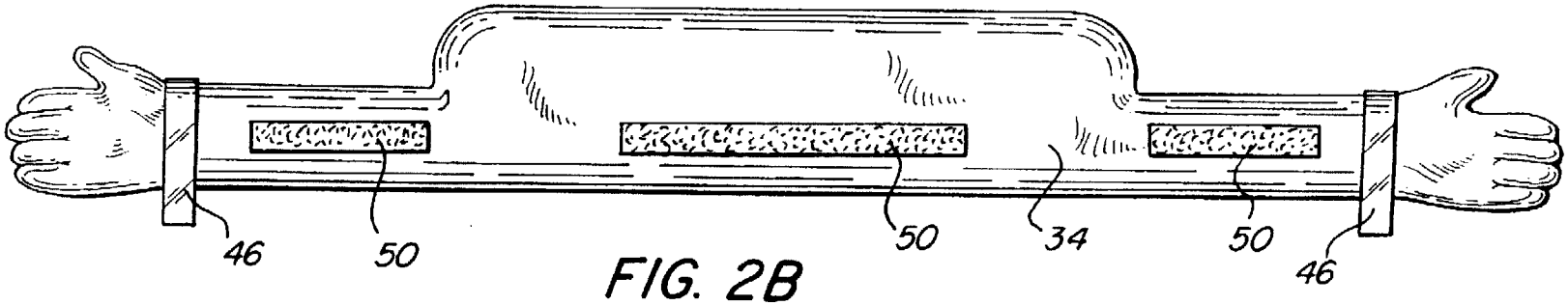
FIG. 2B is a front elevation view of interconnected appendages in accordance with the invention.

Wrapper 48 can be attached to container 14 in any manner sufficient for the intended use of device 10. The positioning of wrapper 48 such that clips 46, for the interconnected appendages, and 20, for the headboard, hold it in place is one means. FIG. 2B illustrates another method for attaching wrapper 48 to container 14. In FIG. 2B, VELCRO is located on the portion of interconnected appendages 34 abuts container 14. VELCRO would also be located the side of wrapper 48 which faces away from container 14, which when joined with the VELCRO on the interconnected appendages, holds wrapper 48 in place. Wrapper 48 could also be supported by joining the two ends of wrapper 48, thereby creating a cylindrical type shape, and attaching elastic, rubber, clips, or the like, to the edge of wrapper 48 nearest the rim of container 14, for added support.

Wrapper 48 can also include a means 52 for propping wrapper 48 into a planar backdrop 54. Means 52 for propping wrapper 48 to form a backdrop 54 in a planar position can be any known in the art which can both accommodate wrapper 48 when flush against container 14 and can hold wrapper 48 in a planar position. For example, a stiff yet flexible strip of plastic, not shown, could be attached to the edge of wrapper 48 closest to the rim of container 14. The ends of the strip of plastic could be fitted with a fastener which joins the two edges of the strip of plastic when it is desired that wrapper 48 fit snugly on container 14. When, however, the edges of the strip of plastic are not joined, the stiffness in the strip of plastic is sufficient to hold wrapper 48 in a substantially planar position, thereby creating a backdrop 54.

Other means 52 for propping wrapper 48 in a planar position could also be employed, such as two telescoping rods, not shown, which is attached to portion of clip 18 on the side opposite the location of sensor 22. The rods are attached so that they can swivel to hang from their point of attachment or can extend away from each other and locked in a substantially horizontal position. When wrapper 48 is attached to the ends of the rods in their fully extended position, opposite their point of attachment to clip 18, wrapper 48 achieves a substantially planar position.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A device for converting a container into a figure to simulate an interactive game with a player, comprising:

a) a headboard in the shape of the head of the figure;

b) a clip affixed to the headboard for attaching the headboard to the container, wherein a portion of the clip extends below the headboard where the clip connects to the container;

c) a sensor mounted to the extending portion of the clip for generating an electrical signal in response to impact on the clip from an object projected by the game player; and d) feedback device responsive to the electrical signal generated by the sensor for providing feedback to the game player.

2. The device of claim 1, wherein the headboard is two dimensional.

3. The device of claim 1, wherein the headboard is three dimensional.

4. The device of claim 1, wherein the feedback device comprises sound effects.

5. The device of claim 1, wherein the feedback device comprises flashing lights.

6. The device of claim 1, wherein the feedback device comprises an electronic counter and corresponding display.

7. The device of claim 1, further comprising two interconnected appendages having clips affixed to the appendages for attaching the interconnected appendages to the container.

8. The device of claim 1, further comprising a sensor placed in the internal cavity of the container for generating an electrical signal in response to impact from an object projected by the game player into the container.

9. A device for converting a container into a figure to simulate an interactive game with a player, comprising:

a) a headboard in the shape of the head of the figure;

b) interconnected appendages having a piece of equipment attached to the appendages, wherein the piece of equipment has an aperture, defined by a rim, to permit an object to pass through the interconnected appendages and into the container, thereby enhancing the enjoyment of the interactive game by creating an optional target for the object;

c) clips affixed to both the headboard and the appendages for attaching them to the container;

d) a sensor mounted to the rim of the aperture in the piece of equipment for generating an electrical signal in response to impact from an object passing through the aperture, wherein the sensor is attached to the rim of the aperture and extends radially inward; and e) feedback device responsive to the electrical signal generated by the sensor for providing feedback to the game player when the object has properly passed through the aperture.

10. The device of claim 9, wherein the headboard is two dimensional.

11. The device of claim 9, wherein the headboard is three dimensional.

12. The device of claim 9, wherein the feedback device comprises sound effects.

13. The device of claim 12, wherein the sound effects additionally has a recording device for allowing the game player to alter the sound effects generated when the object has been properly received by the figure.

14. The device of claim 9, further comprising a sensor placed in the internal cavity of the container for generating an electrical signal in response to impact from an object projected by the game player into the container.

15. A device for converting a container into a figure to simulate an interactive game with a player, comprising:

a) a headboard in the shape of the head of the figure;

b) a clip affixed to the headboard for attaching the headboard to the container;

c) a sensor mounted to the clip for generating an electrical signal in response to impact from an object projected by the game player;

d) at least one sound effect responsive to the electrical signal generated by the sensor for providing feedback to the game player when an object has been properly received by the figure; and e) a recording device for allowing the game player to alter the sound effect generated when the object has been properly received by the figure.

* * * * *